US011450452B2

(12) United States Patent
Urushihara et al.

(10) Patent No.: US 11,450,452 B2
(45) Date of Patent: Sep. 20, 2022

(54) INSULATED FLAT RECTANGULAR CONDUCTOR, COIL, AND METHOD OF PRODUCING INSULATED FLAT RECTANGULAR CONDUCTOR

(71) Applicant: MITSUBISHI MATERIALS CORPORATION, Tokyo (JP)

(72) Inventors: Makoto Urushihara, Hitachinaka (JP); Hideaki Sakurai, Amagasaki (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 16/977,681

(22) PCT Filed: Mar. 1, 2019

(86) PCT No.: PCT/JP2019/008094
§ 371 (c)(1),
(2) Date: Sep. 2, 2020

(87) PCT Pub. No.: WO2019/172120
PCT Pub. Date: Sep. 12, 2019

(65) Prior Publication Data

US 2020/0395146 A1 Dec. 17, 2020

(30) Foreign Application Priority Data

Mar. 5, 2018 (JP) ..... JP2018-038670

(51) Int. Cl.
*H01B 7/08* (2006.01)
*H01B 13/06* (2006.01)
*H01F 5/06* (2006.01)

(52) U.S. Cl.
CPC ..... *H01B 7/08* (2013.01); *H01B 13/06* (2013.01); *H01F 5/06* (2013.01)

(58) Field of Classification Search
CPC ..... H01B 13/00; H01B 13/06; H01B 1/026; H01B 7/02; H01B 7/08; H01B 3/40;
(Continued)

(56) References Cited

U.S. PATENT DOCUMENTS

| | | | | |
|---|---|---|---|---|
| 5,413,838 | A | 5/1995 | Azuma et al. | |
| 2006/0272844 | A1 | 12/2006 | Berghofer et al. | |
| 2009/0236123 | A1* | 9/2009 | Isobe | H01B 1/026 174/117 F |

FOREIGN PATENT DOCUMENTS

| | | | |
|---|---|---|---|
| CN | 101199085 | A | 6/2008 |
| CN | 202352378 | U | 7/2012 |

(Continued)

OTHER PUBLICATIONS

International Search Report dated Mar. 26, 2019, issued for PCT/JP2019/008094 and English translation thereof.

(Continued)

*Primary Examiner* — Krystal Robinson
(74) *Attorney, Agent, or Firm* — Locke Lord LLP; James E. Armstrong, IV; Nicholas J. DiCeglie, Jr.

(57) ABSTRACT

There is provided an insulated flat rectangular conductor including: a flat rectangular conductor; and an insulating film coating the flat rectangular conductor, in which the flat rectangular conductor has a first surface and a second surface opposite to the first surface, and the first surface is rougher than the second surface.

9 Claims, 2 Drawing Sheets

(58) Field of Classification Search
CPC ..... H01B 7/0861; H01B 7/0876; H01F 5/00; H01F 5/06; H01F 17/0013; H01F 27/29; H01F 27/2823; H01F 2017/048; H01F 27/292; H01F 41/042; H01F 17/0006; H01F 27/2804; H01F 41/046; H01F 41/04; H01F 17/04; H01F 2027/2809; H01F 41/0246; H01F 17/045; H01F 27/255; H01F 27/2828; H01F 41/082; H01F 1/26; H01F 27/28; H01F 27/327; H01F 27/24; H01F 27/2852; H01F 41/041; H01F 2017/046; H01F 30/06; H01F 38/10; H01F 27/306; H01F 5/04; H01F 2017/002; H01F 2017/0026; H01F 2017/0073; H01F 27/324; H01F 37/00; H01F 41/061; H01F 41/086; H01F 41/10; H01F 41/122; H01F 1/14766; H01F 2017/0053; H01F 2017/0066; H01F 2017/0093; H01F 2038/143; H01F 27/022; H01F 27/22; H01F 27/2847; H01F 27/32; H01F 27/323; H01F 27/40; H01F 41/06; H01F 41/074; H01F 41/127; H01F 1/20; H01F 1/344; H01F 17/062; H01F 2007/068; H01F 2017/004; H01F 2017/0046; H01F 2027/2814; H01F 2027/2819; H01F 27/245; H01F 27/263; H01F 27/2895; H01F 3/08; H01F 3/10; H01F 38/14; H01F 41/0233; H01F 41/048; H01F 41/063; H01F 6/06; H01F 7/066
See application file for complete search history.

(56) References Cited

FOREIGN PATENT DOCUMENTS

| | | | |
|---|---|---|---|
| CN | 102867601 | A | 1/2013 |
| CN | 203397856 | U | 1/2014 |
| CN | 204707339 | U | 10/2015 |
| CN | 105793933 | A | 7/2016 |
| CN | 106062893 | A | 10/2016 |
| EP | 3239989 | A1 | 11/2017 |
| JP | 2006-221859 | A | 8/2006 |
| JP | 2008-305620 | A | 12/2008 |
| JP | 5102541 | B2 | 12/2012 |
| JP | 2015-082401 | A | 4/2015 |
| JP | 2015-201606 | A | 11/2015 |
| JP | 2016-126866 | A | 7/2016 |
| WO | 2014/115433 | A1 | 7/2014 |

OTHER PUBLICATIONS

Office Action issued in Chinese Patent Application No. CN201980016480.1, dated Jun. 9, 2021.
Search Report issued in European Patent Application No. EP 19764028.7, dated Oct. 13, 2021.

* cited by examiner

INSULATED FLAT RECTANGULAR CONDUCTOR, COIL, AND METHOD OF PRODUCING INSULATED FLAT RECTANGULAR CONDUCTOR

TECHNICAL FIELD

The present invention relates to an insulated flat rectangular conductor, a coil, and a method of producing an insulated flat rectangular conductor.

Priority is claimed on Japanese Patent Application No. 2018-038670, filed Mar. 5, 2018, the content of which is incorporated herein by reference.

BACKGROUND ART

An insulated flat rectangular conductor is obtained by coating a flat rectangular conductor having a substantially rectangular cross section with an insulating film. A coil formed of the insulated flat rectangular conductor is used as an electronic coil for various electronic devices such as a motor and a transformer. The coil formed of the insulated flat rectangular conductor has advantages that a gap between conductors can be reduced and a volume percentage of the conductor occupied in the coil can be increased, compared to a coil formed of an insulated round wire conductor having a substantially circular cross section.

However, there is a problem that the insulating film is easily peeled off, in a case of bending the insulated flat rectangular conductor in a coil shape, compared to the insulated round wire conductor. For this reason, it has been studied to improve adhesion between a flat rectangular conductor and an insulating film.

Patent Literature 1 discloses a copper-resin composite having excellent adhesion properties between copper and a resin, the composite including a metal formed of copper or a copper alloy, and a resin that is bonded to the metal via a nanoporous layer formed on the metal. As a method of forming the nanoporous layer, Patent Literature 1 discloses a method of forming a copper oxide nanoporous layer by irradiating a surface of a metal formed of copper or a copper alloy with a laser.

Patent Literature 2 discloses an insulated electric wire including an insulating film including an innermost insulating film formed by applying a silane coupling agent to an outer periphery of a conductor, and an outermost insulating film formed by applying and baking an enamel wire coating on the innermost insulating film. Patent Literature 2 discloses that an average surface roughness Ra of the conductor is 0.2 to 1.0 μm and discloses etching, roughening by forming copper plating, and surface polishing by sandblasting as a method for performing the roughening to set the surface roughness Ra in the above range.

CITATION LIST

Patent Literature

[Patent Literature 1]
Japanese Unexamined Patent Application, First Publication No. 2015-082401 (A)
[Patent Literature 2]
Japanese Patent No. 5102541 (B)

SUMMARY OF INVENTION

Technical Problem

In order to improve the adhesion between the insulating film and the flat rectangular conductor, it is one of effective methods to form a nanoporous layer on a surface of the flat rectangular conductor as disclosed in Patent Literature 1, or to roughen the surface of the flat rectangular conductor as disclosed in Patent Literature 2. However, when the entire flat rectangular conductor is roughened, foreign substances and the like may easily adhere to the surface of the flat rectangular conductor, and the foreign substances and the like may easily remain even after cleaning. If foreign substances and the like adhere to the surface of the flat rectangular conductor, it is difficult to uniformly coat the surface of the flat rectangular conductor with the insulating film, and a defect of the insulating film may occur.

The invention has been made in view of the above circumstances, and an object of the invention is to provide an insulated flat rectangular conductor in which defects of an insulating film are less likely to occur, and adhesion between a flat rectangular conductor and the insulating film is high, and a coil using the insulated flat rectangular conductor. Another object of the invention is to provide a method of producing an insulated flat rectangular conductor in which defects of an insulating film are less likely to occur and adhesion between a flat rectangular conductor and the insulating film is high.

Solution to Problem

In order to solve the above problems, there is provided an insulated flat rectangular conductor according to an aspect of the invention (hereinafter, referred to as an "insulated flat rectangular conductor of the invention") including: a flat rectangular conductor; and an insulating film that coats the flat rectangular conductor, in which the flat rectangular conductor has a first surface, and a second surface opposite to the first surface, and the first surface is rougher than the second surface.

According to the insulated flat rectangular conductor of the invention having such a configuration, in the flat rectangular conductor, a contact area between the first surface and the insulating film increases, due to the first surface that is rougher than the second surface. Accordingly, the adhesion between the flat rectangular conductor and the insulating film is improved. On the other hand, the foreign substances and the like are less likely to adhere to the second surface due to the second surface that is smoother than the first surface. Accordingly, defects of the insulating film are less likely to occur, when forming the insulating film.

Here, in the insulated flat rectangular conductor of the invention, in the flat rectangular conductor, a surface roughness Ra of the first surface is preferably 0.14 μm or more.

In this case, since the first surface of the flat rectangular conductor has the surface roughness Ra of 0.14 μm or more, the contact area with the insulating film increases, thereby improving the adhesion with the insulating film more reliably.

In the insulated flat rectangular conductor according to the invention, in the flat rectangular conductor, a surface roughness Ra of the second surface is preferably 0.07 μm or less.

In this case, since the second surface of the flat rectangular conductor has the surface roughness Ra of 0.07 μm or less, the foreign substances and the like are less likely to adhere more reliably, and defects of the insulating film are less likely to occur more reliably, when forming the insulating film.

There is a coil according to another aspect of the invention (hereinafter, referred to as a "coil of the invention") that is formed by winding the insulated flat rectangular conductor described above so that the first surface of the flat rectangular conductor becomes an inner side of the coil.

Since the coil of the invention having such a configuration is formed by winding the insulated flat rectangular conductor so that the first surface of the flat rectangular conductor becomes an inner side, the first surface of the flat rectangular conductor and the insulating film are hardly peeled off from each other.

A method of producing an insulated flat rectangular conductor according to still another aspect of the invention (hereinafter, referred to as a "method of producing an insulated flat rectangular conductor of the invention") is a method of producing the insulated flat rectangular conductor described above, and includes: a step of preparing a flat rectangular conductor having a first surface, and a second surface opposite to the first surface; a step of roughening the first surface of the flat rectangular conductor so as to be rougher than the second surface; and a step of coating the roughened surface of the flat rectangular conductor with an insulating film.

According to the method of producing the insulated flat rectangular conductor of the invention having such a configuration, since the roughened surface of the flat rectangular conductor so that the first surface is rougher than the second surface is coated with the insulating film, the contact area between the first surface and the insulating film can be increased, thereby improving the adhesion between the flat rectangular conductor and the insulating film. In addition, the foreign substances and the like are less likely to adhere to the second surface due to the second surface of the flat rectangular conductor that is smoother than the first surface. Accordingly, defects of the insulating film are less likely to occur, when forming the insulating film. Therefore, it is possible to obtain an insulated flat rectangular conductor in which defects of an insulating film are less likely to occur and adhesion between a flat rectangular conductor and the insulating film is high.

Advantageous Effects of Invention

According to the invention, it is possible to provide an insulated flat rectangular conductor in which defects of an insulating film are less likely to occur, and adhesion between a flat rectangular conductor and the insulating film is high, and a coil using the insulated flat rectangular conductor.

In addition, according to the invention, it is possible to provide a method of producing an insulated flat rectangular conductor in which defects of an insulating film are less likely to occur and adhesion between a flat rectangular conductor and the insulating film is high.

DESCRIPTION OF EMBODIMENTS

Hereinafter, an insulated flat rectangular conductor, a coil, and a method for producing an insulated flat rectangular conductor according to an embodiment of the invention will be described with reference to the accompanying drawings.

First Embodiment

Figure 1:
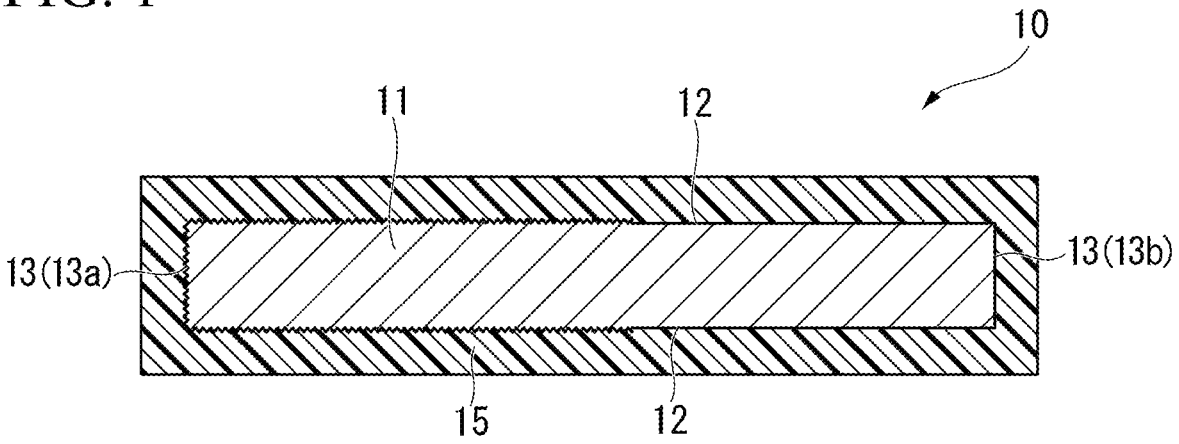
FIG. 1 is a transverse cross-sectional view of an insulated flat rectangular conductor according to a first embodiment of the invention.

FIG. 1 is a transverse cross-sectional view of an insulated flat rectangular conductor according to a first embodiment of the invention.

As shown in FIG. 1, an insulated flat rectangular conductor 10 includes a flat rectangular conductor 11, and an insulating film 15 that coats over the flat rectangular conductor 11.

The flat rectangular conductor 11 has a substantially rectangular cross section and has long side surfaces 12 and short side surfaces 13. In the embodiment, one of the short side surfaces 13 is set as a first surface 13*a*, and the first surface 13*a* is rougher than a second surface 13*b* opposite to the first surface 13*a*.

The first surface 13*a* is a rough surface, and is set so that a contact area with the insulating film 15 is larger than that of the second surface 13*b* and the adhesion to the insulating film 15 is high. A surface roughness Ra of the first surface 13*a* is preferably 0.14 μm or more and more preferably 0.48 μm or more. When the surface roughness Ra of the first surface 13*a* is 0.14 μm or more, the contact area between the first surface 13*a* and the insulating film increases.

If the surface roughness Ra of the first surface 13*a* is excessively great, a gap may easily be generated between the first surface 13*a* and the insulating film 15. For this reason, the surface roughness Ra of the first surface 13*a* is preferably 1.5 μm or less.

The second surface 13*b* is a flat surface, and is set so that foreign substances and the like are less likely to adhere, compared to the first surface 13*a*. A surface roughness Ra of the second surface 13*b* is preferably 0.07 μm or less. When the surface roughness Ra thereof is 0.07 μm or less, foreign substances and the like hardly adhere to the second surface 13*b* more reliably.

The surface roughness Ra of the second surface 13*b* may be 0.03 μm or more. Even if the surface roughness Ra of the second surface 13*b* is set to be less than 0.03 the effect of making it difficult for foreign substances and the like to adhere is saturated, and if the surface is smoothed to set the surface roughness Ra to be less than 0.03 μm, the cost of a smoothing process may increase.

The long side surface 12 may be a rough surface or a smooth surface. In addition, the long side surface 12 may have a rough surface and a flat surface. In this case, it is preferable that a side in contact with the first surface 13*a* is a rough surface and a side in contact with the second surface 13*b* is a smooth surface. In order to improve the adhesion between the flat rectangular conductor 11 and the insulating film 15 and to reduce the adhesion of foreign substances and the like to the surface of the flat rectangular conductor 11, the long side surface 12 is preferably a rough surface in a range of ½ or less of the long side from a corner part where the first surface 13*a* intersects with the long side surface 12.

As a material of the flat rectangular conductor 11, metals and alloys generally used as the material of the flat rectangular conductor for coil can be used. For example, copper, a copper alloy, aluminum, or an aluminum alloy can be used.

A film thickness of the insulating film 15 coating the flat rectangular conductor 11 is preferably in a range of 10 μm to 50 μm.

Examples of the material of the insulating film 15 include a polyester resin, a polyamideimide resin, a polyimide resin, a polyesterimide resin, an acrylic resin, an epoxy resin, an epoxy-acryl resin, a polyester resin, a polyurethane resin, a fluororesin, and the like.

These materials may be used alone or in combination of two or more kinds thereof.

Next, a method for producing the insulated flat rectangular conductor 10 of the embodiment will be described.

The method for producing the insulated flat rectangular conductor 10 of the embodiment includes a step of preparing the flat rectangular conductor 11 having a first surface 13*a* and a second surface 13*b* opposite to the first surface 13*a*; a surface roughening step of roughening the first surface 13*a* of the flat rectangular conductor 11 to be rougher than the second surface 13*b*, and a coating step of coating the roughened surface of the flat rectangular conductor 11 with the insulating film 15.

In the surface roughening step, as a method of roughening the first surface 13*a* of the flat rectangular conductor 11 to be rougher than the second surface 13*b*, for example, a method for immersing the first surface 13*a* in an etchant so that the second surface 13*b* does not come into contact with the etchant can be used.

Specifically, for example, a method for immersing only the first surface 13*a* of the flat rectangular conductor 11 in the etchant, a method for masking the second surface 13*b* and immersing the entire flat rectangular conductor 11 in the etchant, and the like can be used.

An immersion time of the flat rectangular conductor 11 in the etchant is preferably a period of time during which an etching amount of the flat rectangular conductor 11 is within a range of 0.1 μm to 3.0 μm as a thickness of the flat rectangular conductor 11, and particularly preferably a period of time during which the etching amount thereof is within a range of 1.5 μm to 2.0 μm. When the immersion time in the etchant is within this range, a rough surface having the surface roughness Ra excellent in adhesion to the insulating film 15 can be formed.

In the coating step, a method for coating the roughened surface of the flat rectangular conductor 11 with the insulating film 15 is not particularly limited, and for example, a coating method and an electrodeposition method can be used.

The coating method is a method for applying a varnish containing a resin for forming an insulating film and a solvent to a surface of a conductor to form a coating layer, heating the coating layer, and baking a generated insulating film on the conductor.

The electrodeposition method is a method for immersing a conductor and an electrode in an electrodeposition dispersion in which insulating resin particles having electric charge are dispersed, applying a DC voltage between the conductor and the electrode to cause the insulating resin particles to be electrodeposited on the surface of the conductor to form an electrodeposited layer, and heating the electrodeposited layer to bake a generated insulating film on the conductor.

Next, a coil using the insulated flat rectangular conductor 10 will be described.

Figure 2:
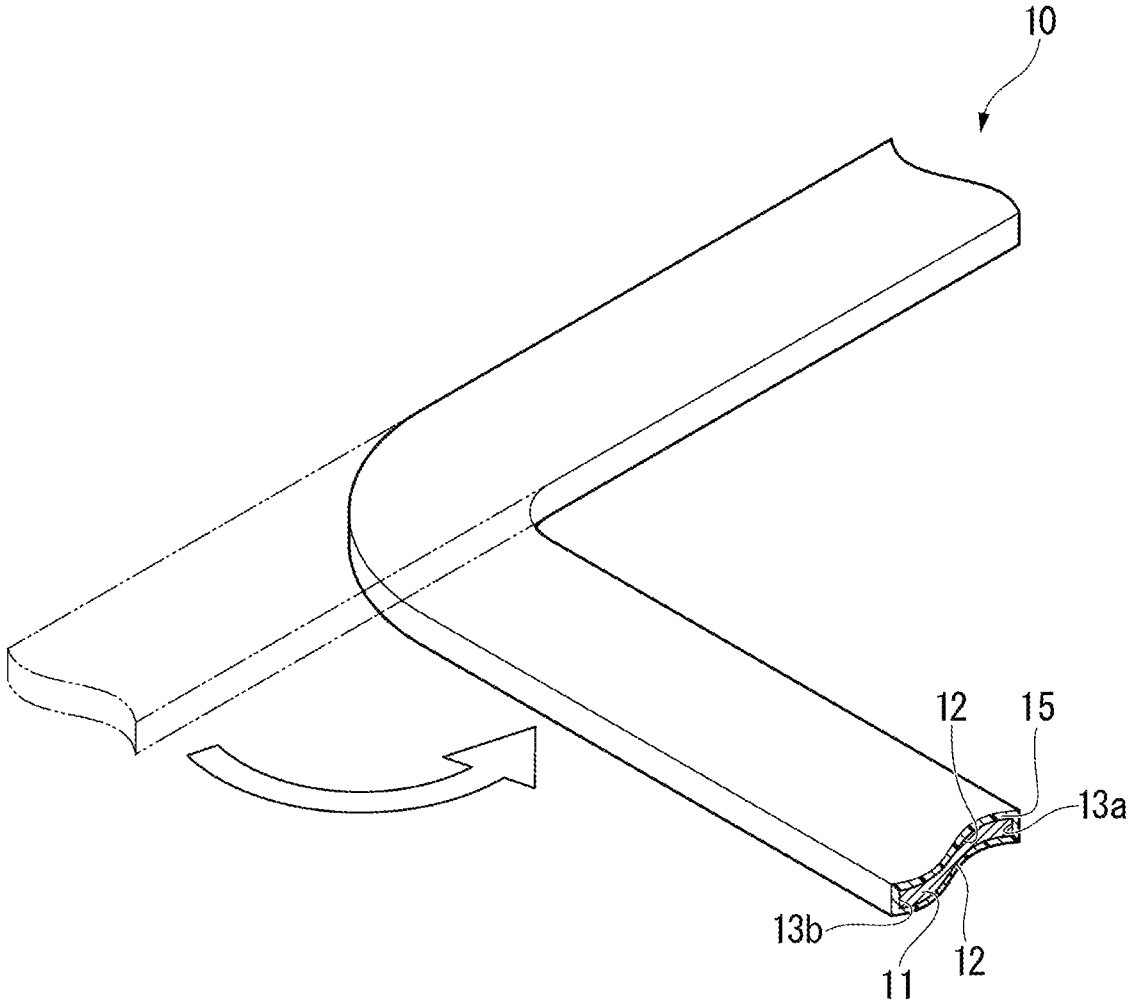
FIG. 2 is a perspective view illustrating a method for producing a coil using the insulated flat rectangular conductor according to the first embodiment of the invention.

FIG. 2 is a perspective view illustrating a method for producing the coil using the insulated flat rectangular conductor 10 according to the first embodiment of the invention.

At the time of producing the coil, as shown in FIG. 2, the insulated flat rectangular conductor 10 is wound so that the first surface 13*a* (edge surface) of the flat rectangular conductor 11 is an inner side, thereby producing a coil (edgewise coil). When the insulated flat rectangular conductor 10 is wound, a compressive stress is applied to the inner side, but by winding the insulated flat rectangular conductor 10 so that the first surface 13*a* having high adhesion to the insulating film 15 is the inner side, the flat rectangular conductor 11 and the insulating film 15 are not easily peeled off. A method for winding the insulated flat rectangular conductor 10 is not particularly limited, and a well-known method generally used in the producing of a normal edgewise coil can be used.

According to the insulated flat rectangular conductor 10 of the first embodiment having such a configuration, the first surface 13*a* which is one of the short side surface 13 of the flat rectangular conductor 11 is set to be rougher than the second surface 13*b* and the contact area between the first surface 13*a* and the insulating film 15 increases. Accordingly, the adhesion between the first surface 13*a* and the insulating film 15 is improved. On the other hand, the foreign substances and the like are less likely to adhere to the second surface 13*b* due to the second surface that is smoother than the first surface 13*a*. Accordingly, defects of the insulating film 15 are less likely to occur, when forming the insulating film 15.

In addition, in the insulated flat rectangular conductor 10 of the embodiment, in the flat rectangular conductor 11, the surface roughness Ra of the first surface 13*a* is set to be 0.14 μm or more. Accordingly, the contact area with the insulating film 15 increases, thereby more reliably improving the adhesion to the insulating film 15.

Further, in the insulated flat rectangular conductor 10 of the embodiment, in the flat rectangular conductor 11, the surface roughness Ra of the second surface 13*b* is set to be 0.07 μm or less. Accordingly, foreign substances and the like are less likely to adhere thereto, thereby making defects of the insulating film 15 are less likely to occur more reliably, when forming the insulating film 15.

In addition, according to the coil of the embodiment, since the coil is made of the insulated flat rectangular conductor 10, and has a shape in which the insulated flat rectangular conductor 10 is wounded in such a way that the first surface 13*a* of the flat rectangular conductor 11 is on inside of the coil, the first surface 13*a* of the flat rectangular conductor 11 and the insulating film 15 are hardly peeled off from each other, even if a compressive stress is applied due to the winding.

In addition, according to the method for roughening a flat rectangular conductor according to the embodiment, since the roughened surface of the flat rectangular conductor 11 so that the first surface 13*a* of the flat rectangular conductor 11 is rougher than the second surface 13*b* is coated with the insulating film 15, the contact area between the first surface 13*a* and the insulating film 15 can be increased, thereby improving the adhesion between the flat rectangular conductor 11 and the insulating film 15. In addition, the foreign substances and the like are less likely to adhere to the second surface due to the second surface 13*b* of the flat rectangular conductor 11 that is smoother than the first surface 13*a*. Accordingly, defects of the insulating film 15 are less likely to occur, when forming the insulating film 15. Therefore, it is possible to obtain the insulated flat rectangular conductor 10 in which defects of an insulating film 15 are less likely to occur and adhesion between a flat rectangular conductor 11 and the insulating film 15 is high.

Second Embodiment

Next, a second embodiment of the invention will be described. In addition, the same reference numerals are used for the same constituent elements as those in the first embodiment, and the detailed description thereof is omitted.

Figure 3:
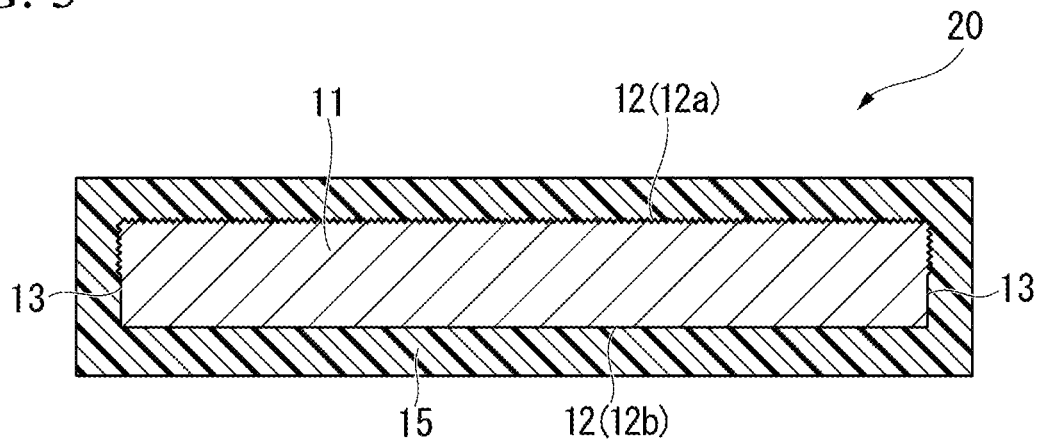
FIG. 3 is a transverse cross-sectional view of an insulated flat rectangular conductor according to a second embodiment of the invention.

FIG. 3 is a transverse cross-sectional view of an insulated flat rectangular conductor according to a second embodiment of the invention.

As shown in FIG. 3, an insulated flat rectangular conductor 20 includes the flat rectangular conductor 11, and the insulating film 15 that coats the flat rectangular conductor 11, and the flat rectangular conductor 11 has a substantially rectangular cross section, and has the long side surfaces 12 and the short side surfaces 13.

This embodiment is different from the first embodiment in terms of improving the adhesion between the first surface 12*a* and the insulating film 15 by setting one of the long side surfaces 12 as a first surface 12*a*, and the first surface 12*a* to be rougher than a second surface 12*b* opposite to the first surface 12*a*. Preferable values of the surface roughness Ra of the first surface 12*a* and the second surface 12*b* are the same as those of the first surface 13*a* and the second surface 13*b* of the first embodiment.

The short side surface 13 may be a rough surface or a smooth surface. In addition, the short side surface 13 may have a rough surface and a flat surface. In this case, it is preferable that a side in contact with the first surface 12*a* is a rough surface and a side in contact with the second surface 12*b* is a smooth surface. In order to improve the adhesion between the flat rectangular conductor 11 and the insulating film 15 and to reduce the adhesion of foreign substances and the like to the surface of the flat rectangular conductor 11, the short side surface 13 is preferably a rough surface in a range of ½ or less of the long side from a corner part where the first surface 12*a* intersects with the short side surface 13.

A film thickness and a material of the insulating film 15 are the same as in the first embodiment.

The method for producing the insulated flat rectangular conductor 20 of the embodiment is the same as the method for producing the insulated flat rectangular conductor 10 described in the first embodiment, except that the first surface 12*a* of the flat rectangular conductor 11 is roughened so as to be rougher than the second surface 12*b* in the surface roughening step. In the surface roughening step, as a method for roughening the first surface 12*a* of the flat rectangular conductor 11 to be rougher than the second surface 12*b*, for example, a method for immersing the first surface 12*a* in an etchant so that the second surface 12*b* does not come into contact with the etchant can be used, in the same manner as in the first embodiment.

Next, a coil using the insulated flat rectangular conductor 20 will be described.

Figure 4:
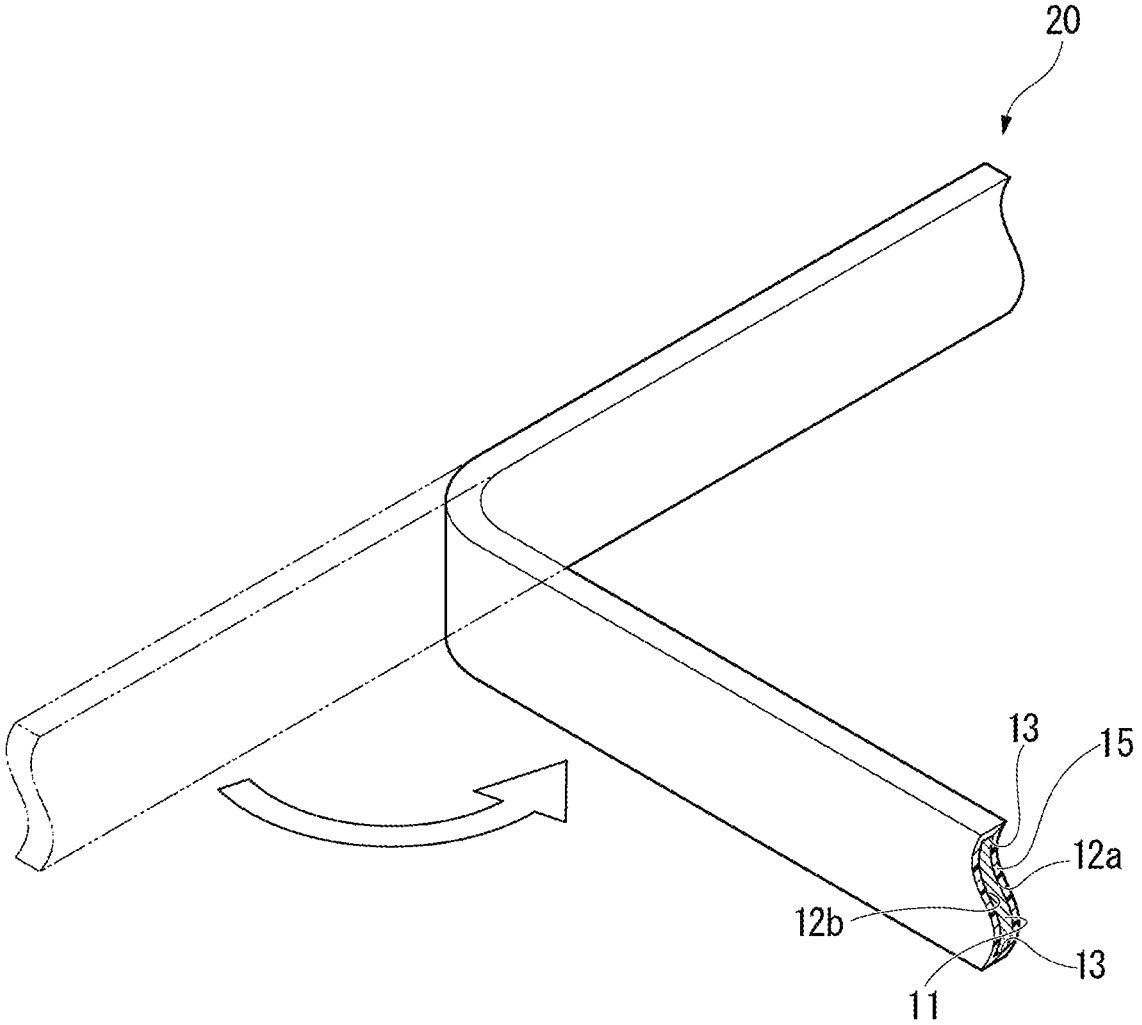
FIG. 4 is a perspective view illustrating a method for producing a coil using the insulated flat rectangular conductor according to the second embodiment of the invention.

FIG. 4 is a perspective view illustrating a method for producing a coil using the insulated flat rectangular conductor 20 according to the second embodiment of the invention.

At the time of producing the coil, as shown in FIG. 4, the insulated flat rectangular conductor 20 is wound so that the first surface 12*a* (flat surface) of the flat rectangular conductor 11 is an inner side, thereby producing a coil (flatwise coil). When the insulated flat rectangular conductor 20 is wound, a compressive stress is applied to the inner side, but by winding the insulated flat rectangular conductor 20 so that the first surface 12*a* having high adhesion to the insulating film 15 is the inner side, the flat rectangular conductor 11 and the insulating film 15 are not easily peeled off. A method for winding the insulated flat rectangular conductor 20 is not particularly limited, and a well-known method generally used in the producing of a flatwise coil can be used.

According to the insulated flat rectangular conductor 20 of the second embodiment having such a configuration, the first surface 12*a* which is one of the long side surface 12 of the flat rectangular conductor 11 is set to be rougher than the second surface 12*b* and the contact area between the first surface 12*a* and the insulating film 15 increases. Accordingly, the adhesion between the first surface 12*a* and the insulating film 15 is improved. On the other hand, the foreign substances and the like are less likely to adhere to the second surface 12*b* due to the second surface that is smoother than the first surface 12*a*. Accordingly, defects of the insulating film 15 are less likely to occur, when forming the insulating film 15.

In addition, in the insulated flat rectangular conductor 20 of the embodiment, in the flat rectangular conductor 11, the surface roughness Ra of the first surface 12*a* is set to be 0.14 μm or more. Accordingly, the contact area with the insulating film 15 increases, thereby more reliably improving the adhesion to the insulating film 15.

Further, in the insulated flat rectangular conductor 20 of the embodiment, in the flat rectangular conductor 11, the surface roughness Ra of the second surface 12*b* is set to be 0.07 μm or less. Accordingly, foreign substances and the like are less likely to adhere thereto, thereby making defects of the insulating film 15 are less likely to occur more reliably, when forming the insulating film 15.

In addition, according to the coil of the embodiment, since the coil is made of the insulated flat rectangular conductor 10, and has a shape in which the insulated flat rectangular conductor 10 is wounded in such a way that the first surface 13*a* of the flat rectangular conductor 11 is on inside of the coil, the first surface 12*a* of the flat rectangular conductor 11 and the insulating film 15 are hardly peeled off from each other.

In addition, according to the method for roughening a flat rectangular conductor according to the embodiment, since the roughened surface of the flat rectangular conductor 11 so that the first surface 12*a* of the flat rectangular conductor 11 is rougher than the second surface 12*b* is coated with the insulating film 15, the contact area between the first surface 12*a* and the insulating film 15 can be increased, thereby improving the adhesion between the flat rectangular conductor 11 and the insulating film 15. In addition, the foreign substances and the like are less likely to adhere to the second surface due to the second surface 12*b* of the flat rectangular conductor 11 that is smoother than the first surface 12*a*. Accordingly, defects of the insulating film 15 are less likely to occur, when forming the insulating film 15. Therefore, it is possible to obtain the insulated flat rectangular conductor 20 in which defects of an insulating film 15 are less likely to occur and adhesion between a flat rectangular conductor 11 and the insulating film 15 is high.

Although the embodiments of the present invention were described above, the present invention is not limited thereto and is able to be appropriately changed without departing from the technical idea of the present invention.

Next, the operation and effect of the invention will be described with reference to examples.

Invention Example 1

(Surface Roughening Treatment of Flat Rectangular Copper Wire)

A long flat rectangular copper wire having a short side of 1.5 mm, a long side of 6.5 mm, and four surfaces having a surface roughness Ra of 0.07 μm was prepared.

One surface of a pair of short side surfaces of this flat rectangular copper wire was defined as a first surface, and the flat rectangular copper wire was immersed in a copper etchant so that the entire first surface, and ½ of the long side from a corner part where the first surface and the long side surface intersect come into contact with the copper etchant. The immersion time was set to a period of time during which the etching amount of the flat rectangular copper wire in contact with the copper etchant was equivalent to a thickness of 0.5 μm.

After the immersion, the flat rectangular copper wire was extracted out of the copper etchant, immersed and cleaned in water, and dried by blowing hot air on the flat rectangular copper wire.

(Producing of Insulated Flat Rectangular Copper Wire)

An insulating film was formed on a surface of a roughened flat rectangular copper wire by an electrodeposition method to produce an insulated flat rectangular copper wire. Specifically, a roughened flat rectangular copper wire and an electrode were immersed in an electrodeposition dispersion containing 2% by mass of polyamideimide (PAI) particles having a negative charge, a DC voltage was applied by using the flat rectangular copper wire as a positive electrode and the electrode as a negative electrode, and the PAI particles were electrodeposited on the surface of the flat rectangular copper wire so that a thickness of a film after drying becomes 40 μm, to form an electrodeposited layer. Then, drying and baking were performed for 5 minutes in a baking furnace (electronic furnace) maintained at 300° C.

(Producing of Coil)

An insulated flat rectangular copper wire was attached to a round bar having a diameter of 6.5 mm which is the same as a long side of the flat rectangular copper wire to perform edgewise bending so that a first surface of the flat rectangular copper wire becomes an inner side and fold to have an L shape (90 degrees) having a bending radius of 3.25 mm, and accordingly, a coil (edgewise coil) having a linear portion and an L-shaped bent portion was produced.

Invention Examples 2 to 4

An insulated flat rectangular copper wire and a coil were produced in the same manner as in Invention Example 1, except that an immersion time of the flat rectangular copper wire in a copper etchant was adjusted in the surface roughening treatment of the flat rectangular copper wire so that the etching amount of the flat rectangular copper wire has a thickness shown in Table 1 below.

Comparative Example 1

An insulated flat rectangular copper wire and a coil were produced in the same manner as in Invention Example 1, except that the surface roughening treatment of the flat rectangular copper wire was not performed.

[Evaluation]

The following evaluations were performed with respect to the insulated flat rectangular copper wires and coils produced in Invention Examples 1 to 4 and Comparative Example 1. Table 1 shows the results thereof.

(Surface Roughness Ra of Flat Rectangular Copper Wire after Surface Roughening Treatment)

A surface roughness Ra of the flat rectangular copper wire after the surface roughening treatment was measured by the following method.

1. The insulated flat rectangular copper wire of the sample is subjected to resin embedding to expose a cross section of the flat rectangular copper wire (a surface perpendicular to a longitudinal direction of the flat rectangular copper wire).

2. Using a scanning electron microscope (SEM), cross-sectional images of a first surface and a second surface of the exposed flat rectangular copper wire are captured. At that time, the cross-sectional images are captured at two portions of the first surface and the second surface, respectively.

3. An interface between the insulating film and the flat rectangular conductor is extracted as the contour curve of the first surface or the second surface, from the cross-sectional image obtained in the section 2.

4. An arithmetic average roughness Ra of the contour curve obtained in the section 3 is calculated. Average values of the arithmetic average roughness Ra obtained from the cross-sectional images captured at two portions of the first surface and the second surface, respectively, are used as the surface roughness Ra of the first surface and the second surface.

(Surface Roughness Ra of Flat Rectangular Copper Wire in L-Shaped Bent Portion of Coil)

The surface roughness Ra of the flat rectangular copper wire in the L-shaped bent portion of the coil was measured in the same as the surface roughness Ra of the flat rectangular copper wire after the surface roughening treatment, except that the insulated flat rectangular copper wire cut out from the L-shaped bent portion was used as a sample.

(Adhesion Between Flat Rectangular Copper Wire in L-Shaped Bent Portion Inside Coil and Insulating Film)

The adhesion between the flat rectangular copper wire and the insulating film was evaluated based on a surface state of the insulating film in the L-shaped bent portion inside the coil. First, the surface of the insulating film in the L-shaped bent portion inside the coil was observed at a magnification of 20 times using an optical microscope to confirm the presence or absence of irregularities. Next, regarding the insulating film having a surface on which irregularities were confirmed, the portion where the irregularities were confirmed was magnified (300 times) and observed from a direction perpendicular to the bending direction, and a baseline passing through a portion without irregularities was drawn to measure a height of the protrusion (distance between the highest position of the protrusion and the baseline). A case where no irregularities were confirmed on the surface of the insulating film was evaluated as "A", a case where no irregularities were confirmed on the surface of the insulating film and the height of the protrusion was less than 5 μm was evaluated as "B", and a case where the height of the protrusion was 5 μm or more was evaluated as "C".

TABLE 1

| | Etching amount of roughening treatment | Surface roughness Ra of flat rectangular copper wire (μm) | | | | Adhesion between flat rectangular copper wire in L-shaped bent portion inside coil and insulating film |
|---|---|---|---|---|---|---|
| | | After roughening treatment | | L-shaped bent portion of coil | | |
| | | First surface | Second surface | First surface | Second surface | |
| Invention Example 1 | 0.5 μm | 0.14 | 0.07 | 0.19 | 0.07 | B |
| Invention Example 2 | 1.0 μm | 0.35 | 0.07 | 0.53 | 0.07 | B |
| Invention Example 3 | 1.5 μm | 0.48 | 0.07 | 0.70 | 0.07 | A |
| Invention Example 4 | 2.0 μm | 0.55 | 0.07 | 0.78 | 0.07 | A |
| Comparative Example 1 | Not treated | 0.07 | 0.07 | 0.08 | 0.07 | C |

In the coil formed by winding the insulated flat rectangular copper wire of Comparative Example 1, in which the surface of the first surface of the flat rectangular copper wire was not roughened, a protrusion having a height of 5 μm or more was confirmed on the surface of the insulating film in the bent portion inside the coil, and it was confirmed that the adhesion between the flat rectangular copper wire and the insulating film was low.

In contrast, in the coil formed by winding the insulated flat rectangular copper wire of Invention Examples 1 to 4, in which the surface of the first surface of the flat rectangular copper wire was roughened, a protrusion having a height of 5 μm or more was not confirmed on the surface of the insulating film in the bent portion inside the coil, and it was confirmed that the adhesion between the flat rectangular copper wire and the insulating film was improved. Particularly, in the coil formed by winding the insulated flat rectangular copper wire of Invention Examples 3 and 4, in which the surface roughness Ra of the first surface of the flat rectangular copper wire was 0.48 μm or more, no irregularities were observed on the surface of the insulating film of the bent portion inside the coil, and it was confirmed that the adhesion between the flat rectangular copper wire and the insulating film was significantly improved.

Invention Examples 5 to 7 and Comparative Example 2

The surface roughening treatment of the first surface of the flat rectangular copper wire was performed under the same conditions as in Invention Example 4.

Next, a portion of the flat rectangular copper wire that has not been subjected to the surface roughening treatment (the entire second surface, and the portion within a range of ½ of the long side from a corner part where the second surface intersects a long side surface) was immersed in a copper etchant to roughen the flat rectangular copper wire. The immersion time of the flat rectangular copper wire in the copper etchant was adjusted so that the etching amount of the flat rectangular copper wire had a thickness shown in Table 2 below. Finally, an insulating film was formed on the flat rectangular copper wire having the first surface and the second surface subjected to the surface roughening treatment, in the same manner as in Invention Example 1 to produce an insulated flat rectangular copper wire.

[Evaluation]

The following evaluations were performed with respect to the insulated flat rectangular copper wires produced in Invention Examples 5 to 7, Comparative Example 2, and Invention Example 4. Table 2 shows the results thereof.

(Surface roughness Ra)

A surface roughness Ra of the flat rectangular copper wire after the surface roughening treatment was measured by the same method as described above.

(Presence or Absence of Cracks on Outer Side of L-Shaped Bent Portion after Bending Test)

An insulated flat rectangular copper wire was attached to a round bar having a diameter of 6.5 mm to perform edgewise bending so that a first surface of the flat rectangular copper wire becomes an inner side and fold to have an L shape (90 degrees) having a bending radius of 3.25 mm, to perform the bending test.

Regarding the insulated flat rectangular copper wire after the folding test, the surface of the insulating film in the L-shaped bent portion was observed at a magnification of 20 times using an optical microscope to confirm the presence or absence of cracks on the insulating film. A case where cracks, such that the surface of the flat rectangular copper wire was directly visible, were generated was evaluated as "present", and a case where cracks, such that the surface of the flat rectangular copper wire was directly visible, were not generated was evaluated as "none".

(Total Etching Amount)

A total etching amount of the flat rectangular copper wire subjected to the surface roughening treatment in Invention Examples 5 to 7 and Comparative Example 2 was calculated by setting a total etching amount of the flat rectangular copper wire having only the first surface subjected to the surface roughening treatment in Invention Example 4 as 1. For example, in Invention Example 5, since the etching amount of the first surface is 1 and the etching amount of the second surface is 25% of the first surface, the total etching amount is 1.25 (=1+0.25).

TABLE 2

| | First surface | | Second surface | | Presence or absence of cracks on outer side of | Total |
|---|---|---|---|---|---|---|
| | Etching amount | Surface roughness Ra (μm) | Etching amount | Surface roughness Ra (μm) | flat rectangular copper wire after bending test | etching amount (relative value) |
| Invention Example 4 | 2.0 μm | 0.55 | Not treated | 0.07 | None | 1 |
| Invention Example 5 | 2.0 μm | 0.55 | 0.5 μm | 0.14 | None | 1.25 |
| Invention Example 6 | 2.0 μm | 0.55 | 1.0 μm | 0.35 | None | 1.5 |
| Invention Example 7 | 2.0 μm | 0.55 | 1.5 μm | 0.48 | None | 1.75 |
| Comparative Example 2 | 2.0 μm | 0.55 | 2.0 μm | 0.55 | None | 2 |

No cracks were observed on the outer side of the L-shaped bent portion after the bending test for any of the insulated flat rectangular copper wires produced in Invention Examples 4 to 7 and Comparative Example 2. As the total etching amount increases, the surface roughness Ra of the flat rectangular copper wire increases. Accordingly, foreign substances and the like may easily adhere. For this reason, it is preferable that the flat rectangular copper wire has a small total etching amount, that is, the second surface is a flat surface. Therefore, in Invention Examples 4 to 7 and Comparative Example 2, in terms of the ease of adhesion of foreign substances and the like, Inventive Example 4 having the smallest total etching amount is most preferable.

INDUSTRIAL APPLICABILITY

It is possible to provide an insulated flat rectangular conductor in which defects of an insulating film are less likely to occur, and adhesion between a flat rectangular conductor and the insulating film is high, and a coil using the insulated flat rectangular conductor.

REFERENCE SIGNS LIST

10, 20 Insulated flat rectangular conductor
11 Flat rectangular conductor
12 Long side surface
12*a* First surface
12*b* Second surface
13 Short side surface
13*a* First surface
13*b* Second surface
15 Insulating film

What is claimed is:

1. An insulated flat rectangular conductor, which is for an edgewise coil that is configured to be wound so that a first surface on the short side is on the inside, comprising:
a flat rectangular conductor; and
an insulating film coating the flat rectangular conductor,
wherein the flat rectangular conductor has said first surface and a second surface opposite to the first surface, and
the first surface is one of the short side surfaces and the second surface is the other of the short side surfaces, and
the first surface is rougher than the second surface, and
in the flat rectangular conductor, a surface roughness Ra of the first surface is 0.14 μm or more and a surface roughness Ra of the second surface is 0.07 μm or less.

2. A coil which is formed by winding the insulated flat rectangular conductor according to claim 1 so that the first surface of the flat rectangular conductor becomes an inner side of the coil.

3. A method of producing the insulated flat rectangular conductor according to claim 1, the method comprising:
a step of preparing a flat rectangular conductor having a first surface, and a second surface opposite to the first surface;
a step of roughening the first surface of the flat rectangular conductor so as to be rougher than the second surface; and
a step of coating the roughened surface of the flat rectangular conductor with an insulating film.

4. A coil which is formed by winding the insulated flat rectangular conductor according to claim 1 so that the first surface of the flat rectangular conductor becomes an inner side of the coil.

5. A coil which is formed by winding the insulated flat rectangular conductor according to claim 1 so that the first surface of the flat rectangular conductor becomes an inner side of the coil.

6. A method of producing the insulated flat rectangular conductor according to claim 1, the method comprising: a step of preparing a flat rectangular conductor having a first surface, and a second surface opposite to the first surface; a step of roughening the first surface of the flat rectangular conductor so as to be rougher than the second surface; and a step of coating the roughened surface of the flat rectangular conductor with an insulating film.

7. A method of producing the insulated flat rectangular conductor according to claim 1, the method comprising: a step of preparing a flat rectangular conductor having a first surface, and a second surface opposite to the first surface; a step of roughening the first surface of the flat rectangular conductor so as to be rougher than the second surface; and a step of coating the roughened surface of the flat rectangular conductor with an insulating film.

8. The insulated flat rectangular conductor according to the claim 1,
wherein the flat rectangular conductor has a substantially rectangular cross section.

9. The insulated flat rectangular conductor according to claim 1, wherein the flat rectangular conductor has long side surfaces which connect the first surface and the second surface, wherein each of the long side surfaces has a rough surface which is in contact with the first surface and a smooth surface which is in contact with the second surface.

* * * * *